US006978717B1

(12) United States Patent
Hambric

(10) Patent No.: US 6,978,717 B1
(45) Date of Patent: Dec. 27, 2005

(54) INFRARED CAMERA DEPLOYED BY GRENADE LAUNCHER

(75) Inventor: Harry N. Hambric, Pembroke Pines, FL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/922,482

(22) Filed: Aug. 16, 2004

(51) Int. Cl.[7] ..... F42B 10/00

(52) U.S. Cl. ..... 102/473; 89/1.1; 89/1.11; 348/211.99; 348/211.2; 348/211.4

(58) Field of Search ..... 89/1.1; 42/105, 42/106; 102/473; 348/211.2, 211.4, 211.99

(56) References Cited

U.S. PATENT DOCUMENTS

| | | | | | |
|---|---|---|---|---|---|
| 2,406,816 | A * | 9/1946 | Elmer et al. | 369/156 |
| 3,233,415 | A * | 2/1966 | Thomas | 52/155 |
| 3,502,025 | A * | 3/1970 | Payne | 102/512 |
| 3,584,582 | A * | 6/1971 | Muller | 102/512 |
| 3,672,304 | A * | 6/1972 | Roger et al. | 102/516 |
| 3,695,555 | A * | 10/1972 | Chadwick | 244/3.14 |
| 3,715,953 | A * | 2/1973 | Allan | 89/36.14 |
| 3,962,537 | A * | 6/1976 | Kearns et al. | 348/144 |
| 4,945,834 | A * | 8/1990 | Young | 102/473 |
| 4,964,341 | A * | 10/1990 | Hebert | 102/501 |
| 5,111,748 | A * | 5/1992 | Thurner et al. | 102/387 |
| 5,181,673 | A * | 1/1993 | Hubricht et al. | 244/3.12 |
| 5,467,681 | A * | 11/1995 | Liberman | 89/1.11 |
| 6,119,976 | A * | 9/2000 | Rogers | 244/13 |
| 6,142,410 | A * | 11/2000 | Naccache | 244/3.12 |
| 6,260,797 | B1 * | 7/2001 | Palmer | 244/49 |
| 6,373,521 | B1 * | 4/2002 | Carter | 348/144 |
| 6,392,213 | B1 * | 5/2002 | Martorana et al. | 244/3.1 |
| 6,510,776 | B2 * | 1/2003 | Sirmalis et al. | 89/1.11 |
| 6,576,880 | B2 * | 6/2003 | Martorana et al. | 244/3.1 |
| 6,650,283 | B2 * | 11/2003 | Brydges et al. | 342/357.07 |
| 6,764,041 | B2 * | 7/2004 | Oron | 244/3.16 |
| 6,779,457 | B2 * | 8/2004 | Kutzli et al. | 102/223 |
| 6,807,908 | B2 * | 10/2004 | Brydges-Price | 102/512 |
| 6,869,044 | B2 * | 3/2005 | Geswender et al. | 244/3.29 |
| 6,924,838 | B1 * | 8/2005 | Nieves | 348/211.99 |
| 2003/0011706 | A1 * | 1/2003 | Chang et al. | 348/375 |
| 2003/0132846 | A1 * | 7/2003 | Hilliard | 340/573.2 |
| 2004/0066451 | A1 * | 4/2004 | Schroth | 348/144 |
| 2004/0075585 | A1 * | 4/2004 | Kaiser et al. | 340/946 |
| 2004/0089186 | A1 * | 5/2004 | Brygdes-Price | 102/502 |
| 2004/0196367 | A1 * | 10/2004 | Raymond et al. | 348/144 |
| 2005/0188886 | A1 * | 9/2005 | Vasel et al. | 102/502 |

* cited by examiner

*Primary Examiner*—Michael J. Carone
*Assistant Examiner*—John A Radi
(74) *Attorney, Agent, or Firm*—William H. Anderson

(57) ABSTRACT

A projectile in a cartridge designed to be launched from a grenade launcher. The projectile is adapted to be secured to the housing of the cartridge. The projectile includes a camera contained in the projectile body and connected thereto by a cord, and a transmitter contained in the projectile body and connected to the camera. In addition, the projectile includes elements for pinning the front part of the projectile body to a target, and elements for separating the front part of the projectile body from the back part of the projectile body and expelling the camera from the projectile body when the projectile is pinned to the target so that the camera is freely suspended from the projectile by the cord and can rotate in a wind through 180 degrees to observe its surroundings and transmit images thereof.

15 Claims, 2 Drawing Sheets

INFRARED CAMERA DEPLOYED BY GRENADE LAUNCHER

GOVERNMENT INTEREST

The invention described herein may be manufactured, used, sold, imported, and/or licensed by or for the Government of the United States of America.

FIELD OF INTEREST

This invention relates in general to surveillance systems, and more particularly, to surveillance camera systems.

BACKGROUND OF THE INVENTION

In the past, cameras have been located at remote sites for surveillance purposes. Sometimes it is difficult to locate the camera at the site because the site is inaccessible.

SUMMARY OF THE INVENTION

It is therefore an object of this invention to locate a surveillance camera at a remote site for surveillance purposes.

This and other objects of the invention are achieved in one aspect by a projectile in a cartridge designed to be launched from a grenade launcher. The projectile is adapted to be secured to the housing of the cartridge. The projectile includes a camera contained in the projectile body and connected thereto by a cord, and a transmitter contained in the projectile body and connected to the camera. In addition, the projectile includes means for pinning the front part of the projectile body to a target, and means for separating the front part of the projectile body from the back part of the projectile body and expelling the camera from the projectile body when the projectile is pinned to the target so that the camera is freely suspended from the projectile by the cord and can rotate in a wind through 180 degrees to observe its surroundings and transmit images thereof.

Another aspect of the invention involves a surveillance method comprising the steps of disposing a camera and a transmitter inside a projectile, connecting the camera to the projectile by a cord, launching the projectile, pinning the projectile to a target, separating the front part of the projectile body from the back part of the projectile body, expelling the camera from the projectile body so that the camera is freely suspended from the projectile by the cord and can rotate in a wind through 180 degrees to observe its surroundings, and transmitting images of the surroundings.

The invention allows the camera to hang freely regardless of the angle of impact of the projectile. There is no operator control.

BRIEF DESCRIPTION OF THE DRAWINGS

These and other objects of the invention will become readily apparent in light of the Detailed Description of the Preferred Embodiment and the attached drawings wherein.

DETAILED DESCRIPTION OF THE PREFERRED EMBODIMENT

Figure 1:
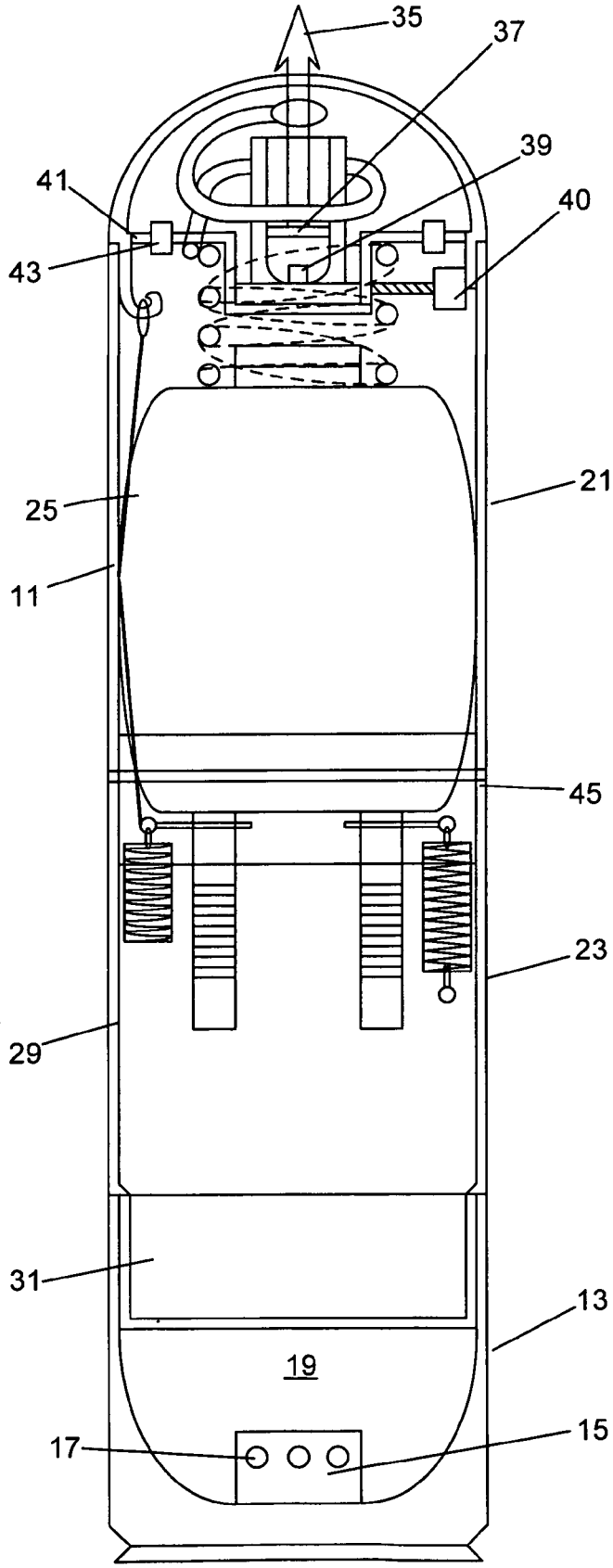
FIG. 1 is a schematic illustration of the cartridge incorporating the projectile embodying the invention.

Referring to the Figures, wherein like reference numerals designate like or corresponding parts, and more particularly to FIG. 1, there is schematically illustrated a cartridge incorporating the projectile of the present invention. The cartridge is designed to be launched from the M203 or other model(s) 40-mm Grenade Launcher. Since such cartridges are known in the art of kinetic energy projectiles it will be described only insofar as necessary to set forth the cooperative relationship of the present invention.

The cartridge comprises three major components: a projectile 11, a housing 13 connected to the projectile, and a propulsion system 15 disposed in an opening in the housing. The housing 13 serves to retain the projectile 11 and the propulsion system 15 as well as prevent gas leakage into the breech area of the grenade launcher. The propulsion system 15 includes a propellant charge 17 and a free volume 19 for the accumulation of combustion gases, in addition to means of venting these gases into the grenade launcher chamber. The projectile 11 is secured to the housing by an interference fit. This causes a lip on the mouth of the housing 13 to engage an undercut in the projectile 11 body.

In operation, the cartridge is loaded into a grenade launcher attached to a rifle or stand-alone launcher device. The primer is struck by the grenade launcher firing-pin which initiates the primer compound and subsequently the charge 17. As the propellant burns, the pressure increases in the grenade launcher chamber and the projectile 11 unseats from the housing 13. The projectile then accelerates down the barrel of the grenade launcher projectile 11 unseats from the housing 13. The projectile then accelerates down the barrel of the grenade launcher while engaging the bore rifling, which transmits spin torque to the projectile 11. After firing, the grenade launcher breech can be opened, the spent housing extracted, and a fresh cartridge inserted.

Since the present invention is deemed to reside in the projectile 11, further description of the other elements of the cartridge, which are well known to those skilled in the art, is considered superfluous.

The projectile 11 includes a projectile body having a front part 21 and a back part 23. The back part 23 of the projectile body is adapted to be secured to the housing 13. The front part 21 of the projectile body contains an infrared camera 25 which is connected to the projectile body by a cord 27. The back part 23 of the projectile body contains a video transmitter 29 which is connected to the camera 25, and a battery 31 which is connected to the camera and to the transmitter. Both the infrared camera 25 and the transmitter 29 may be cameras that are commercially available. In addition, the projectile body includes means for pinning the front part 21 of the projectile body to a target 33, and means for separating the front part 21 of the projectile body from the back part 23 of the projectile target 33, so that the camera is freely suspended from the projectile by the cord 27 and can rotate in a wind through 180 degrees to observe its surroundings and transmit images thereof.

While the pinning means may take a variety of forms, conveniently it may take the form of a nail 35, a main charge 37 and a squib 39 for firing the nail, and an accelerometer 40 connected to the squib.

While the separating and expelling means may likewise take a variety of forms, conveniently it may take the form of a wall 41 having a plurality of pressure ducts 43 which separates the main charge 37 and the squib 39 from the camera 25, and a breakable link 45 which connects the front part 21 of the projectile body to the back part 23 of the projectile body.

Figure 2:
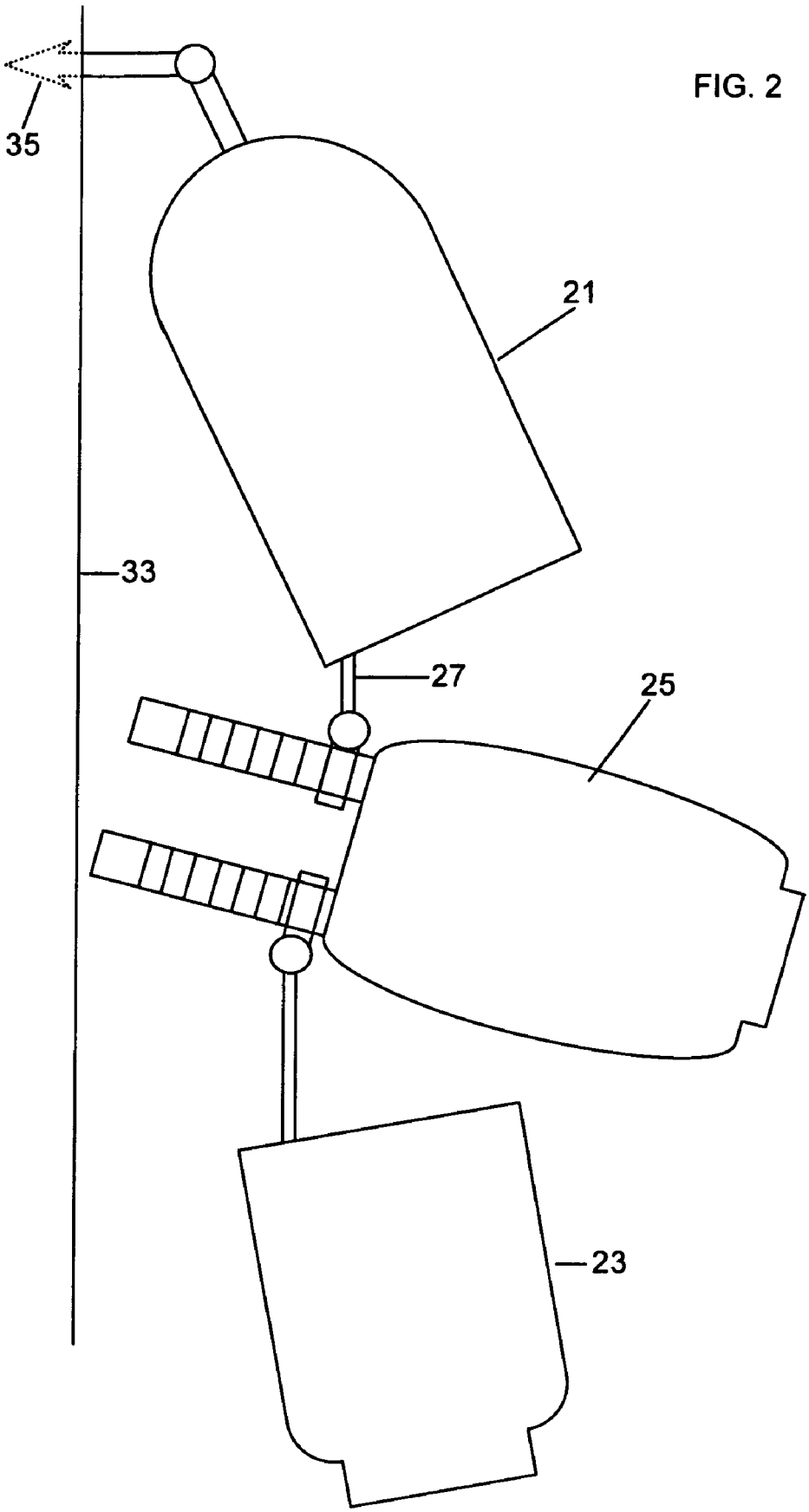
FIG. 2 shows the projectile of FIG. 1 after impacting a target.

In operation, when the front part 21 of the projectile body impacts the target 33, the accelerometer 40 senses the impact and activates the squib 39 to set off the main charge 37 so that the nail 35 shoots forward and pins the projectile to the target. The gases from the explosion of the main charge 37 forcibly expand through the pressure ducts 43 cushioning the payload's impact causing the link 45 to break and separate the front part 21 and back part 23 of the projectile. The infrared camera 25 drops out of the 45 to break and separate the front part 21 and back part 23 of the projectile. The infrared camera 25 drops out of the projectile, as shown in FIG. 2, and hangs freely by the cord 27. The camera 25 may be balanced so that it assumes a specific tilt angle. The design allows the wind to freely rotate the camera 25 through 180 degrees. The video transmitter 29 may then send images from the camera 25 to a remote surveillance receiver.

It is obvious that many modifications and variations of the present invention are possible in light of the above teachings. It is therefore to be understood that within the scope of the appended claims, the invention may be practiced otherwise than as described.

What is claimed is:

1. In a cartridge designed to be launched from a grenade launcher, the cartridge having a housing and a propulsion system, a projectile comprising:

a projectile body having a front part and a back part, the back part of the projectile body adapted to be secured to the housing;

a camera contained in the projectile body and connected thereto by a cord;

a transmitter contained in the projectile body and connected to the camera;

means for pinning the front part of the projectile body to a target; and means for separating the front part of the projectile body from the back part of the projectile body and expelling the camera from the projectile body when the projectile is pinned to the target so that the camera is freely suspended from the projectile by the cord and can rotate in a wind through 180 degrees to observe its surroundings and transmit images thereof.

2. The projectile recited in claim 1 wherein the pinning means includes:

a nail in the front part of the projectile body designed to be shot forward into the target on impact of the projectile with the target.

3. The projectile recited in claim 2 wherein the pinning means includes:

a main charge and a squib in the projectile body for shooting the nail forward.

4. The projectile recited in claim 3 wherein the pinning means includes an accelerometer in the projectile body for sensing the impact and activating the squib to explode the main charge.

5. The projectile recited in claim 3 wherein the separating and expelling means includes:

a wall having a plurality of pressure ducts separating the main charge and the squib from the camera.

6. The projectile recited in claim 5 wherein the cushioning, separating and expelling means includes:

a breakable link connecting the front part of the projectile body to the back part of the projectile body.

7. The projectile recited in claim 5 wherein the pinning means includes:

a nail in the front part of the projectile body designed to be shot forward into the target on impact of the projectile with the target.

8. The projectile recited in claim 7 wherein the pinning means includes:

a main charge and a squib in the projectile body for shooting the nail forward.

9. The projectile recited in claim 8 wherein the pinning means includes;

an accelerometer in the projectile body for sensing the impact and activating the squib to explode the main charge.

10. The projectile recited in claim 3 wherein the separating and expelling means includes:

a wall having a plurality of pressure ducts separating the main charge and the squib from the camera.

11. The projectile recited in claim 10 wherein the separating and expelling means includes:

a breakable link connecting the front part of the projectile body to the back part of the projectile body.

12. The projectile recited in claim 1 wherein:

the camera is an infrared camera.

13. The projectile recited in claim 1 wherein:

the transmitter is a video transmitter.

14. The projectile recited in claim 1 wherein;

the camera is an infrared camera and the transmitter is a video transmitter.

15. In a cartridge designed to be launched from a grenade launcher, the cartridge having a housing and a propulsion system, a projectile comprising:

a projectile body having a front part and a back part, the back part of the projectile body adapted to be secured to the housing;

an infrared camera contained in the projectile body and connected thereto by a cord;

a video transmitter contained in the projectile body and connected to the camera;

a nail in the front part of the projectile body designed to be shot forward into a target on impact of the projectile with the target;

a main charge and a squib in the projectile body for shooting the nail forward; an accelerometer in the projectile body for sensing the impact and activating the squib to explode the main charge;

a wall having a plurality of pressure ducts separating the main charge and the squib from the camera; and a breakable link connecting the front part of the projectile body to the back part of the projectile body, the link breaking and the camera dropping out of the projectile when gases from the explosion of the main charge forcibly expand through the plurality of pressure ducts so that the camera is freely suspended from the projectile by the cord and can rotate in a wind through 180 degrees to observe its surroundings and transmit images thereof.

* * * * *